US005600331A

United States Patent [19]

Buralli

[11] Patent Number: 5,600,331

[45] Date of Patent: Feb. 4, 1997

[54] CONICAL MICROSTRIP ANTENNA PREPARED ON FLAT SUBSTRATE AND METHOD FOR ITS PREPARATION

[75] Inventor: Bernard Buralli, Cannes La Bocca, France

[73] Assignee: Aerospatiale Societe Nationale Industrielle, France

[21] Appl. No.: 364,482

[22] Filed: Dec. 23, 1994

[30] Foreign Application Priority Data

Dec. 31, 1993 [FR] France ..... 93 15971

[51] Int. Cl.[6] ..... H01Q 1/38

[52] U.S. Cl. ..... 343/700 MS; 343/853

[58] Field of Search ..... 343/700 MS, 705, 343/708, 853, 846, 795, 850; 29/846, 825, 847; H01Q 1/38

[56] References Cited

U.S. PATENT DOCUMENTS

| | | | |
|---|---|---|---|
| 4,101,895 | 7/1978 | Jones | 343/700 MS |
| 4,160,976 | 7/1979 | Conroy | 343/700 MS |
| 4,605,932 | 8/1986 | Butscher et al. | 343/708 |
| 4,816,836 | 3/1989 | Lalezari | 343/700 MS |

FOREIGN PATENT DOCUMENTS

| | | |
|---|---|---|
| 0575211 | 12/1993 | European Pat. Off. . |
| 2692404 | 12/1993 | France . |
| 2244381 | 11/1991 | United Kingdom . |
| 2248344 | 4/1992 | United Kingdom . |

OTHER PUBLICATIONS

Toute L'Electronique, No. 548, Nov. 1989, Paris, France, pp. 18–22; J. P. Daniel et al, "Conception et Realisation de Reseaux d'antennes Imprimees".

*Primary Examiner*—Hoanganh T. Le
*Attorney, Agent, or Firm*—Remy J. VanOphem; Thomas A. Meehan; John VanOphem

[57] ABSTRACT

A conical microstrip antenna carried by a frustum of a cone with a half-angle at the apex α, height $H_0$ and a circular reference line of radius R, includes an annular succession of N radiating patches disposed on the frustum and divided into at least one sub-array of radiating patches connected with equal phase by a respective tree-structure feed array to the same common point, the N radiating patches being made on a dielectric material to resonate in a predetermined frequency band having a center frequency Fo. The tree-structure array is formed of n stages each including dividers of the same order, either the second order or the third order. When developed onto a flat surface, the dividers within the same stage i are made up of an integer number of substantially identical straight line segments with equal angles γ2 between them, the dividers of the same stage approximating arcs of a common circle concentric with the circular arc formed by the circular reference line in the shape developed onto a flat surface.

14 Claims, 6 Drawing Sheets

CONICAL MICROSTRIP ANTENNA PREPARED ON FLAT SUBSTRATE AND METHOD FOR ITS PREPARATION

BACKGROUND OF THE INVENTION

1. Field of the Invention

The invention concerns a conical microstrip belt antenna with good radio frequency performance that can be designed and printed on a flat substrate. It also concerns the preparation of an antenna of this kind on a flat substrate.

2. Description of the Prior Art

An electromagnetic wave, characterized among other parameters by its wavelength, conveying energy and usually embodying information can propagate in various media, the main media of interest in the present context being:

guided propagation media (cables, lines, waveguides, etc.), and unguided propagation media (free space, whether homogeneous or not, whether isotropic or not, etc.).

One characteristic parameter of an electromagnetic wave is its wavelength $\lambda$ (the ratio of the speed of light to the frequency of the signal transmitted).

An antenna can be regarded as an interface between these two types of media, enabling total or partial transfer of electromagnetic energy from one to the other. The transmit antenna passes this energy from the guided propagation medium to the unguided propagation medium and the receive antenna reverses the direction of transfer of energy between the media. In the remainder of this description the transmit antenna is usually referred to by implication. However, the principle of reciprocity means that all the stated properties apply to the receive antenna.

The feed circuit(s) or device of the antenna embodies components of all or part of the guided propagation medium directing or collecting the electromagnetic energy to be transferred and embodying passive or active devices, reciprocal or otherwise.

A unit antenna is often associated with one or more geometrical points called phase centers from which the electromagnetic wave appears to emanate for a given direction of transmission in the case of a transmit antenna.

The antenna resonates at the frequency or frequencies for which the transfer of energy transmitted from the feed line into space via the antenna is optimal, which can be expressed in mathematical terms as follows: at the resonant frequency fr the complex impedance Z at the antenna input has a null imaginary part and a maximal real part.

At microwave frequencies, the locus of impedances is plotted on the Smith chart on which each resonance appears as a loop.

With current measuring instrumentation, this resonance is "seen" through the matching that is characteristic of transfer of energy from the feed line to the antenna. This view of the behavior of the antenna can be termed the response of the antenna and is quantified by mismatch loses or the Voltage Standing Wave Ratio (VSWR) defined below.

If Z is the impedance at the point at which the matching is measured and Zc is the characteristic impedance of the feed line (under the standard usually adopted, Zc=50 ohms), then the reflection coefficient is the complex ratio:

$$P=(z-1)/(z+1)$$

where z=Z/Zc. The VSWR is defined as follows:

$$VSWR=|(1+|P1)/(1-|P1)|$$

Unfortunately, a radiating element does not usually have an impedance equal to Zc. A "matching" interface must be inserted between the radiating element and the cable conveying the energy. Its purpose is to convert the impedance Ze at the antenna input to an impedance presented to the feed cable which is near the impedance Zc at the operating frequencies of the antenna, with a VSWR close to 1.

The radio frequency performance of an antenna is characterized by parameters including:

the Voltage Standing Wave Ratio (VSWR), which reflects the quality of matching, i.e. the quantity of energy transmitted from the feed line to the antenna; the better the quality of matching, the closer to VSWR=1;

the antenna radiation pattern which is a diagram showing the distribution in space of the vector E (electromagnetic field) of the wave, with which the standard parameters are associated (gain, directivity, efficiency, −3 dB aperture, coverage probability, etc.).

By convention, the radiation pattern is shown in a system of axes centered at a point on the antenna (its phase center, if possible) and embodies a set of "cross-sections" in a standard system of spherical coordinates ($\theta\phi$). A "constant $\phi$" section shows the curve of variation of the field E projected onto a given polarization (either $E\theta$ or $E\phi$), for $\theta$ varying from 0° to 180° (or from −180° to +180° ). Similarly, a "constant $\theta$" section is a curve showing the variation of the field E projected onto a given polarization (either $E\theta$ or $E\phi$), for $\phi$ varying from 0° to 360°.

An association of unit antennas is called an antenna array if the unit antennas have common parts in their feed circuits or if coupling between the unit antennas makes the overall radiation pattern of the array in a given range of frequencies dependent on that of each of the unit antennas or radiating elements.

The array obtained by distributing antennas similar to one or more given unit antennas over a given surface is often called an array antenna, usually implying the concept of geometrical repetition of the unit antennas.

Array antennas are usually employed to obtain a highly directional radiation pattern in a given direction relative to the array.

The spacing $\Delta$ between the phase centers of the unit antennas of the array, relative to the wavelength $\lambda o$ in the propagation medium, for example air, is a critical parameter.

For example, for values of $\Delta/\lambda o>0.5$, significant array lobes outside the wanted radiation area penalize the energy transmission balance in the unguided propagation medium.

The microstrip technology resides in stacking a plurality of layers of conductive or dielectric material such as a dielectric substrate (glass fiber-reinforced PTFE, for example) coated on its lower side (or I side) with a conductive film (of copper, gold, etc.) and carrying on its upper side (or S side) a conductive film cut into a given geometrical design (usually referred to as "patches").

This system can:

either guide an electromagnetic wave (microstrip line), or radiate an electromagnetic field (microstrip antenna).

The current propagation medium is:

either the air-substrate interface, or the air-conductor-substrate interface.

In the former case the effective dielectric constant of the medium is defined by convention as:

$$\in e=(\in r+1)/2$$

Where $\in r$ is the dielectric constant of the substrate. In the later case:

$$\epsilon e = 0.5(\epsilon r + 1) + 0.5(\epsilon r - 1)/\sqrt{(1 + 12h/W)}$$

where h is the thickness of the substrate and W is the width of the conductive strip.

Various types of component and other devices (possibly active components and devices) can usually be mounted on the S side of the structure.

By definition, a microstrip antenna is a geometrically shaped conductive material element on the S side of a dielectric layer.

A rectangular or circular shape is often chosen, for the following reasons:

the radiation pattern is largely predictable, the dimensioning of these antennas to resonate a given frequency is well understood.

A rectangular microstrip patch is to some degree equivalent to two parallel slots coinciding with two radiating edges of the rectangle. The selection of the edges of a rectangular patch which must radiate (and by extension those which must not radiate) is effected by an appropriate choice of the area of the rectangle connected to the feed circuit.

The rectangular patch is usually fed near or at the median line joining the sides which are to radiate. In this way, the mode excited in the resonator produces linear polarization of good quality. The direction of this polarization is perpendicular to the radiating edge of the patch.

This connection can be made through the dielectric substrate or at the periphery of the patch by means of a microstrip line on the S side (this is sometimes called "coplanar feeding"); see for example French Patent 2,226,760.

It is essentially the distance L between these edges (called the "length" of the patch) which determines the resonant frequency of the antenna.

Equations and charts have been developed for this.

For example, according to "MICROSTRIP ANTENNAS", I. J. Bahl and P. Bhartia, ARTECH HOUSE, 1980, to resonate at the frequency fr a rectangular patch must have a length L such that:

$$L = \frac{1}{2\lambda o\sqrt{(\epsilon e)}} + 0.412\frac{(\epsilon e + 0.3)(W + 0.264h)}{(\epsilon e - 0.258)(W + 0.8h)}$$

where:

$$\epsilon e = 0.5(\epsilon r + 1) + 0.5(\epsilon r - 1)/\sqrt{(1 + 12h/W)},$$

$\epsilon r$ is the dielectric constant of the dielectric substrate, h is the height (or thickness) of the substrate, $\lambda o$ is the wavelength in air at the frequency fr (i.e. the ratio of the speed of light to this frequency), and W is the width of the patch, obtained from a simple formula given in the above work:

$$W = 1/(\lambda o\sqrt{(2(\epsilon r + 1))})$$

The width W of the patch conditions the radiation pattern of the antenna.

The width W chosen conditions to a large degree the quality of radiation, i.e. its efficiency and its shape.

According to the above document, the radius of a circular patch is given by the following formula:

$$R = K\left\{1 + \frac{2h}{\sqrt{\pi}\,\epsilon rK}\left[\ln\frac{\sqrt{\pi}\,K}{2h} + 1.7726\right]\right\}^{0.5}$$

where $K = 8.794/(fr\sqrt{\epsilon r})$

Any microstrip patch can be used as an element of an array of the following types:

serial, parallel, a combination of the two.

This technology can provide antennas (or antenna arrays) which are:

thin, light in weight, of low cost (being easy and quick to manufacture), that can be "conformed", for example to apply them to cylindrical or conical structures.

The microstrip antenna is in fact an electronic resonator which by construction has a high Q. Because of this, antennas using this technology always have a narrow bandwidth, i.e. resonance occurs only at the frequency for which the antenna is dimensioned and at frequencies very close to this frequency.

As already mentioned, a matching interface (or feed system or array) is usually required between the radiating patch and the feed cable. The simplest solution is usually to print the matching interface on the same side of the substrate as the radiating patch itself. The matching interface most commonly used, because of its simplicity, is the so-called "quarter-wave" matching interface. Its performance is mediocre, however. In the microstrip technology, the impedance of a line of width W printed onto a substrate of thickness e with dielectric constant $\epsilon r$ is given by the following equation (see "Computer-Aided Design of Microwave Circuits", K. C. GUPTA, RAMESH GARG AND RAKESH CHADHA, Artech):

$$Z = 120\pi/\{\sqrt{\epsilon e}\ [W/e + 1.393 + 0.667\ln(W/e + 1.444)]\}$$

for W/e greater than or equal to 1, or

Z=60ln (8e/W+0.25W/e) for W/e less than or equal to 1.

This equation indicates that on a given substrate the characteristic impedance of a microstrip line is conditioned by the width of the line. The wider the line the lower the impedance.

Let Ze denote the impedance at the entry point of the radiating patch. If Zd is the impedance required at the interface with the feed system (the cable, for example), the quarter-wave matching interface is then a section of printed line whose length is $\lambda g/4$ (where $\lambda g = \lambda/\epsilon e$ is the wavelength in the dielectric) and has a characteristic impedance $Zc = \sqrt{(Ze/Zd)}$.

There are other types of matching interface (the "streamlined" line, for example), whose complexity often goes hand in hand with:

enhanced efficiency (low losses through spurious radiation), a wider usable band of frequencies.

A number of applications of the microstrip technology to so-called "conformed" antennas, i.e. antennas applied to a non-plane surface, have already been described.

For example, in French patent application 92-07274 the patches are distributed over the surface of a cylinder. The objective of this antenna, called a "belt antenna" is to produce an omnidirectional radiation patch, i.e. to provide a gain which is as uniform as possible in all regions of space. The patches are equidistant and can be grouped into identical sub-arrays also incorporating the feed array for routing the signal to each element. All are fed with the same amplitude and the same phase (to within a given tolerance) to guarantee a regular radiation pattern.

The invention is also directed to achieving good radio frequency performance (in particular with regard to the radiation patch), but from a microstrip belt antenna applied to a conical body, following preparation on a plane substrate according to a realistically and reliably determined design, the law for feeding of the antenna of the present invention being identical to that of the preceding example, for example.

The only problem in designing a cylindrical belt antenna like that described in French patent application 92-07274 is that of designing a one-dimensional feed array (a single row of elements to be fed) which is correctly matched (VSWR of approximately one) at the operating frequency or frequencies. This does not present any great problem to the person skilled in the art, using either standard equations or preferably a CAD system. Each sub-array is designed on a plane surface and retains its matching properties when wrapped onto the cylindrical body.

Designing this type of antenna for application to a conical body is more complex, if all the radiating elements must be:

- equidistantly and conveniently spaced (by a distance less than or close to one half-wavelength),
- situated at the same altitude, i.e. at the same height relative to the reference base of the frustum,
- fed with the same amplitude and phase (to within a given tolerance).

The above are the necessary and sufficient conditions for obtaining an omnidirectional radiation pattern.

The present invention proposes a method of designing and fabricating this type of antenna on a plane surface like a printed circuit before applying it to a cone and a type of antenna that can be fitted onto any given cone with the only modification of the cone that is required being the provision of one or more holes for the feed cable(s).

The following patents (identified as documents D1–D9) discuss or touch on this problem:

D1: U.S. Pat. No. 3,914,767,

D2: U.S. Pat. No. 4,101,895,

D3: U.S. Pat. No. 3,798,653,

D4: U.S. Pat. No. 4,980,692,

D5: U.S. Pat. No. 4,051,480,

D6: U.S. Pat. No. 2,490,024,

D7: U.S. Pat. No. 4,160,976,

D8: U.S. Pat. No. 4,816,836,

D9: EP-A-0,575,211.

These prior art references describe concepts based on slot technology (documents D3 and D6) or microstrip technology or techniques derived therefrom.

Documents D3 and D6 describe antennas which are an integral part of the structure on which they are disposed. This does not correspond to the requirements stated above (minimal impact on the support structure).

Documents D1, D2, D4 and D5 have frequent recourse to numerous and costly short-circuits through the substrate (in order to guarantee sufficient bandwidth—which the previously mentioned French patent application 92 07274 can avoid) and provide no information as to the feed system or array of the antenna, so that it may be assumed that a technique other than the microstrip technique is used. One of the major benefits of this technique is precisely the fact that it enables combination on the same support (the dielectric substrate) of the feed array and the radiating elements, so eliminating many of the mechanical constraints encountered with antennas using other technologies.

Document D7 proposes a microstrip antenna applied to a cylindrical body with no precise information as to the design or dimensions of the feed array or system. Document D8 concerns a two-layer array antenna structure on a cylindrical or conical surface but gives no specific information as to the radiating patches or their feed array.

Document D9, already cited, concerns only a cylindrical belt antenna. However, the unit radiating patch described in this document combines a thin dielectric substrate with a wide bandwidth. This patch can be used with advantage in the present invention.

SUMMARY OF THE INVENTION

The invention proposes a conical microstrip antenna carried by a frustum of a cone with a half-angle at the apex $\alpha$, height $H_o$ and a circular reference line of radius R. An annular succession of N radiating patches is disposed on the frustum and is divided into at least one sub-array of radiating patches connected by a respective feed array to the same common point (G). The N radiating patches are made of a conductive metal on a surface of a layer of dielectric material, and the layer of dielectric material carries on its other surface a conductive layer forming a ground plane. The radiating patches are shaped to resonate in a predetermined frequency band having a center frequency Fo.

The feed array of each sub-array of radiating patches is made up of conductive lines forming a tree-structure array of dividers such that the line lengths between the common point and the radiating patches of the sub-array are substantially identical to within $c/(Fo\sqrt{\in e})$ where c is the speed of light and $\in e$ is the effective dielectric constant of the propagation medium constituted by the substrate and the conductive lines.

The tree-structure array is formed on the same surface of the dielectric material layer as the sub-array of radiating patches, and the tree-structure array is formed of n stages, each including dividers of the same order, either the second order or the third order.

When developed onto a flat surface, the dividers within the same stage i are made up of an integer number of substantially identical straight line segments with equal angles $\lambda 2$ between them, the dividers of the same stage approximating arcs of a common circle concentric with the circular arc formed by the circular reference line in the shape developed onto a flat surface.

In accordance with preferred features of the invention, some of which may be combinable with others:

- the N radiating patches are divided into S identical sub-arrays and the length $\Delta La_i$ of the rectilinear segments of stage i and the angle $\gamma_i$ between adjacent segments are such that:
  - a) $Na_i = La_i/\Delta La_i$ is an integer number (the number of sections for stage i) greater than or equal to 1, where:

$$La_i = 2\pi \sin(\alpha) Ra_i 2^{\delta 3}/[S\,(2^{i-m}3^m)]$$

where $\delta 3$ is Chrönecker's symbol, which has the value 1 if stage i is a third order stage or the value 0 if stage i is a second order stage, m is the number of third order stages between the first stage and the ith stage, the stages being counted from the common point, and $$Ra_i = H/\cos(\alpha) - h + (n - i + 1)\, p \sum_{k=1}^{k=i} h_k$$

where p is 1 if the feed array is under the radiating elements and −1 if the feed array is over the radiating elements, h is the distance between the reference line of the frustum and the edge of the radiating element connected to the feed array, and $h_k$ is the height of stage k; and b) the angle τi is equal to $\Delta La_i/Ra_i$, the radiating elements are trapezoidal in shape, the radiating elements are rectangular in shape, the radiating elements are circular in shape, the radiating elements are those described in document D9, i.e. each patch is formed of a conductive loop of constant width 1 around a dummy patch that is not energized and separated from the dummy patch by a continuous closed-loop slot of constant width 1 coupling the loop and the dummy patch, the length of the rectilinear segments is made at least equal to approximately one-quarter the wavelength in the dielectric material, and the height of each stage is the same.

The invention also proposes a method of preparing a microstrip antenna adapted to be carried by a frustum of a cone with a half-angle α at the apex, of height $H_0$ and having a circular reference line of radius R, the antenna including an annular succession of N radiating patches disposed on the frustum and divided into at least one sub-array of radiating patches connected by a respective feed array to the same common point (G), the N radiating patches being made from a conductive material on a surface of a dielectric material layer, the dielectric material layer carrying on its other surface a conductive layer forming a ground plane, and the radiating patches being shaped to resonate in a predetermined frequency band having a center frequency $F_O$, in which method:

* numbers S, n2 and n3 are chosen arbitrarily such that $N=S2^{n2}3^{n3}$.

the N radiating patches are divided into S sub-arrays, each feed array is such that the line lengths between the common point and the radiating patches of the sub-array are substantially identical to within $c/(F_0 \sqrt{\in e})$ where c is the speed of light and ∈e is the effective dielectric constant of the propagation medium constituted by the substrate and conductive lines, the tree-structure array is formed on the same surface of the dielectric material layer as the sub-array of radiating patches, the tree-structure array is made up of n2 stages of second order dividers and n3 stages of third order dividers, in any order, the dividers are conformed within the same stage i so that each, when developed on a plane, is an integer number of substantially identical straight line segments with equal angles $\gamma_i$ between them, the dividers of a same stage approximating arcs of a common circle concentric with the circular arc constituted by the circular reference line when developed on the plane.

The preferred features defined above also apply to this method.

Objects, features and advantages of the invention emerge from the following description given by way of non-limiting example with reference to the appended drawings.

DETAILED DESCRIPTION OF THE PREFERRED EMBODIMENTS

The constraint whereby the radiating elements or patches are fed at the same level and the same phase in a given frequency band imposes a constraint on their number N. The feed array must have a tree structure including various divider stages between the radiating elements and a common feed point (or signal input). The length of the lines between the signal input point (the interface with the cable) and each of the radiating elements must be equal (to within an integer number of wavelengths) to guarantee the equal-phase character of the microstrip feed array.

If n is the number of second order divider stages in the array and the latter does not include any divider stage of an order other than the second order (in practice of the third order), then $N=2^n$.

This limitation, which allows only numbers of radiating elements equal to 4, 8, 16, 32, 64, 128, etc., represents a heavy penalty and may prove incompatible with a given geometrical problem. In this case, it may be tempting to include a divider by three in the feed array. However, a divider by three can be used only if the lengths of the lateral branches are equal (to the nearest integer number of wavelengths) to the length of the central branch.

Even in this case, the solution obtained is necessarily a degraded instance of the uniform feed tree-structure array. The feed is uniform in phase only at the center frequency of the working band and is never really uniform in amplitude because of ohmic losses in the lateral lines. For this latter reason such dividers are often restricted to the last stage of the array because the length differences are small (usually one wavelength); patches connected to a divider of the final stage are in principle adjacent.

If n is the number of second order stages of the array and m is the number of third order stages, then $N=3^m2^n$.

Feed arrays of this kind for a conical surface will now be described in more detail.

Figure 1:
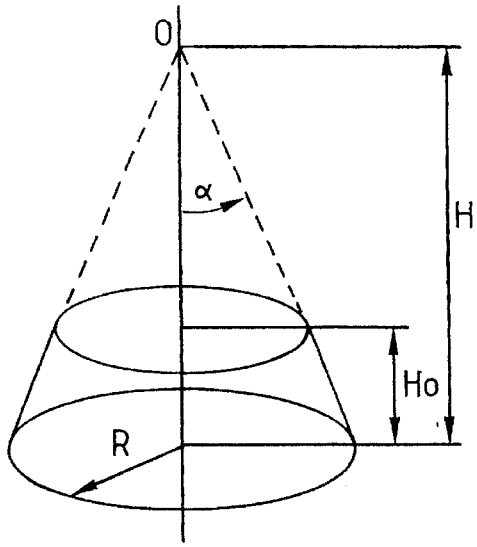
FIG. 1 shows a cone with a half-angle at the apex α and of height H containing a frustum of height Ho and base radius R.

Referring to FIG. 1, a cone has a height H and a half-angle α at the apex. A frustum of a cone T has a height Ho and a base radius R. An array antenna is to be wrapped around this frustum.

Figure 2:
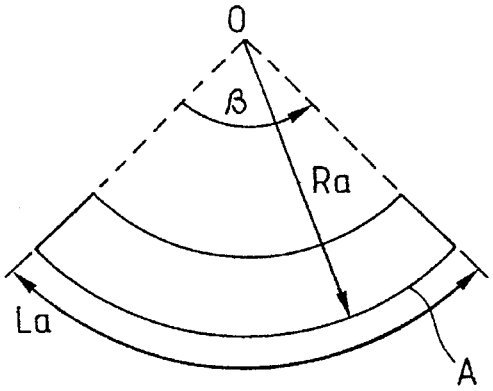
FIG. 2 shows the developed shape of the cone from FIG. 1.

Referring to FIG. 2, developed in the flat the cone is an angular sector with an apex 0 and one edge in the shape of a circular arc A with radius $Ra=H/\cos(\alpha)$, length $La=2\pi R$ and subtending an angle$\beta=2\pi\sin(\alpha)$. Its sides are two straight line segments intersecting at the center O of the circle of which the arc A is part and whose other ends are the end points of the arc A.

Figure 7:
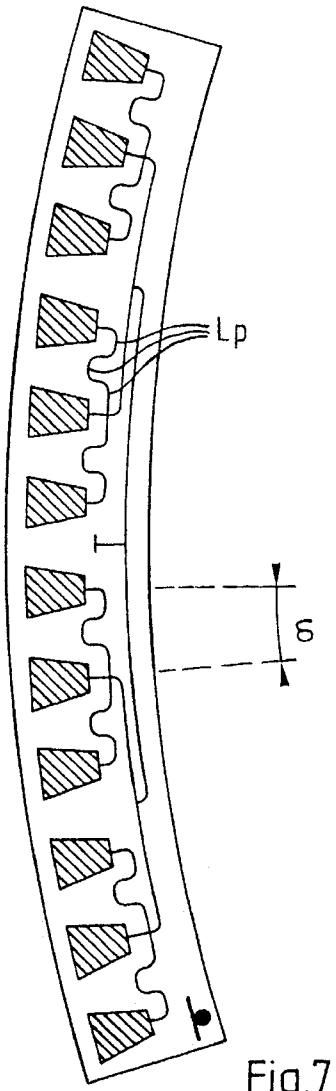
FIGS. 6 and 7 show the exact developed shapes (etching mask or offset film) of two strip antenna applications for conical surfaces.
Figure 6:
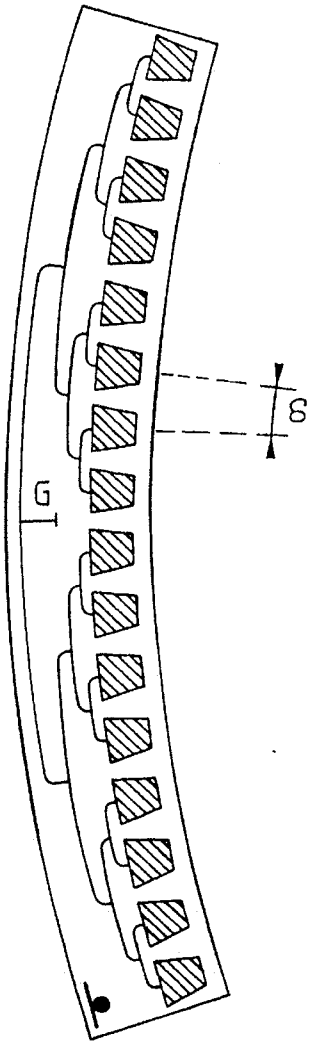

Referring to FIGS. 6 and 7, there are two options:

option 1: the radiating elements can be under the feed array (on the opposite side of the feed array to the apex), option 2: the radiating elements can be above the feed array (on the same side as the apex).

In both cases, it is immediately apparent that only the direction of variation of the indices of the stages changes. The geometrical description of the two options is therefore the same, apart from this detail, the repercussions of which are explained in the application examples described at the end of this text.

Figure 3A:
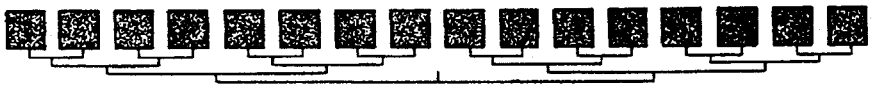
FIGS. 3A to 3D show examples of tree-structured feed arrays for belt antennas (or cylindrical belt antenna sub-arrays) with second order and/or third order divider stages.
Figure 3B:
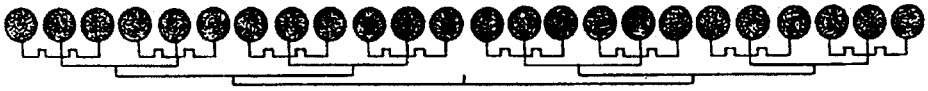
Figure 3C:
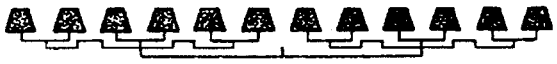
Figure 3D:
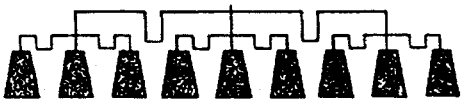

There are also two scenarios of practical importance:

first scenario: all the divider stages of the feed array are second order stages (FIG. 3A), second scenario: one or more divider stages of the feed array are third order stages (FIGS. 3B, 3C and 3D).

This latter scenario is that adopted in the following general geometrical description and in the applications described later.

Also, the complete belt antenna can be made up of S identical sub-arrays, in which case the following method and formulas no longer apply to a complete array (complete belt) but to a sub-array, subject to conditions explained below. Let δ denote the angle between the centers of the end radiating elements relative to the point O (see FIG. 6 or FIG. 7), assuming that the elements are regularly spaced on the cone. Thus:

$$\delta=\beta/N \tag{1}$$

If the antenna is made up of S sub-arrays and Ns is the number of radiating elements per sub-array, i.e. the number of radiating elements connected to the same common point G, then:

$$Ns=N/S$$

Assume initially that the array includes only second order dividers. Given the structure of the chosen feed array, Ns is equal to $2^n$ where n is the number of divider stages in the feed array.

Figure 4:
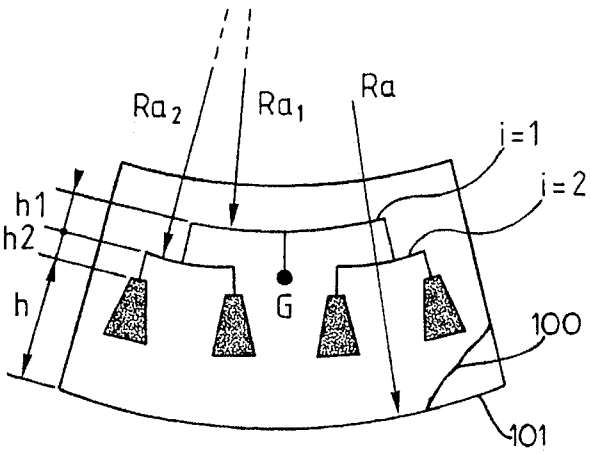
FIG. 4 is a simple example of the developed shape of a conical belt antenna with four radiating elements and whose feed array is made up of circular arc lines.

As shown in FIG. 4, the feed array of the sub-array in question is ideally made up of circular arcs of radius $Ra_i$ and length $La_i$ such that:

$$Ra_i = Ra - h + p\sum_{k=1}^{k=i} h_k \tag{2}$$

$$La_i = \delta Ra_i Ns/2^i = \beta Ra_i/(S2^i) \tag{3}$$

where:

i is the index of the stage concerned $1<i<n$ where $n=\mathrm{Log}_2(N)$ is the number of stages of the array, p is 1 if the feed array is under the radiating elements or −1 if the feed array is over the radiating elements (FIG. 4), h is the distance between the base of the frustum and the edge of the radiating patch connected to the feed array, and $h_i$ is the height of divider stage i.

As is known by the person skilled in the art, the patches are made of a conductive metal and are provided on the face of a dielectric substrate 100, the lower surface of which is provided with a conductive layer 101 forming a ground plane.

If $h_i=h_{i-1}=h_1=h_0$, then equation (2) can be written:

$$Ra_{i=Ra-h+p}(n-i+1)h_0 \tag{2'}$$

If a number of stages of the feed array are third order stages, then equation (3) must be adapted accordingly:

$$La_{i=\delta Rai}Ns2^{\delta 3}/(2^{i-m}3^m)=\beta Ra_i/(S2^{i-m}3^m) \tag{3'}$$

where:

i is the index of the stage in question (second or third order) such that $1<i<n$ where n is the total number of stages in the sub-array and $n=n^2+n^3$ where $n^2$ is the number of second order stages and $n^3$ is the number of third order stages, such that $Ns=2^{n2}3^{n3}$, δ3 is Chrönecker's symbol, which has the value 1 if stage i is a third order stage or the value 0 if this stage is a second order stage, and m is the number of third order stages between the first stage and the ith stage.

The lines of the corresponding arc must be divided into several short circular arcs enabling the provision of a step in order to make up the phase (to the nearest 2kπ) at the two lateral branches relative to the center branch (see stage 3 in FIG. 7).

If possible, the third order divider (if it is the only one) is usually in the third stage of the feed array to minimize the impact of phase-shifts at the edge of the working frequency band.

In this case, in the final stage equation (3') becomes: $La_n=\delta Ra_n N2/(2^{n-1}3)$.

If an arc is divided into three "sub-arcs" (see the third order dividers in FIG. 7) with a step for the median sub-arc, then the length Lp of each circular sub-arc can be: $Lp=La_{n__}/6$. If in the ith stage the ith step has a height equal to hj then the radius of the corresponding arc is either R=Rai−hj or R=Rai+hj, depending on the direction of the step.

Designing a microstrip array made up of curved lines can become a virtually insoluble problem since present day CAD tools can process virtually only straight lines. Approximating curved shape adapters by straight lines can generate errors. An empirical approach is the norm in the field of radiating patch antenna design.

For this reason, in accordance with the invention, all the arcs of the feed array are approximated by segments of substantially the same length, at least within each stage. Each segment is inclined relative to the adjacent segments by an accurately calculated angle.

The order of magnitude of the length of each segment is chosen arbitrarily at the outset, and is advantageously close to or greater than one quarter of the wavelength in the dielectric.

Let $\Delta'_{La}$ be the selected length. This can arbitrarily have the same value in each stage of the array or differ from one stage to the next, in which case it can be denoted $\Delta'_{Lai}$. The number of segments per stage is then given by the equation:

$$N'ai=La_i/\Delta'_{Lai}$$

because Nai must be an integer:

$$N'ai=int(N'ai)=int\ (La_i/\Delta'_{Lai}) \quad (4)$$

and the exact length of the straight line segments is:

$$\Delta_{Lai}=La_i/Nai \quad (5)$$

Figure 5:
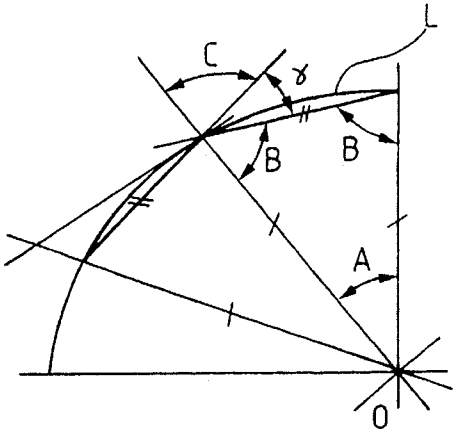
FIG. 5 shows a circular arc approximated by equal segments.
Figure 8B:
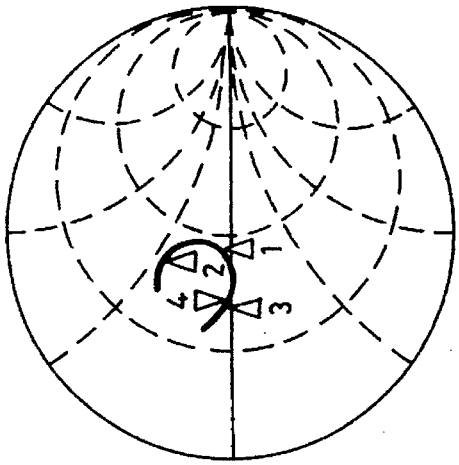
FIGS. 8A, 8B, 9A and 9B show the respective performance in terms of matching of antennas made from the offset film of FIGS. 6 and 7, by means of a VSWR/frequency diagram a SMITH chart.
Figure 8A:
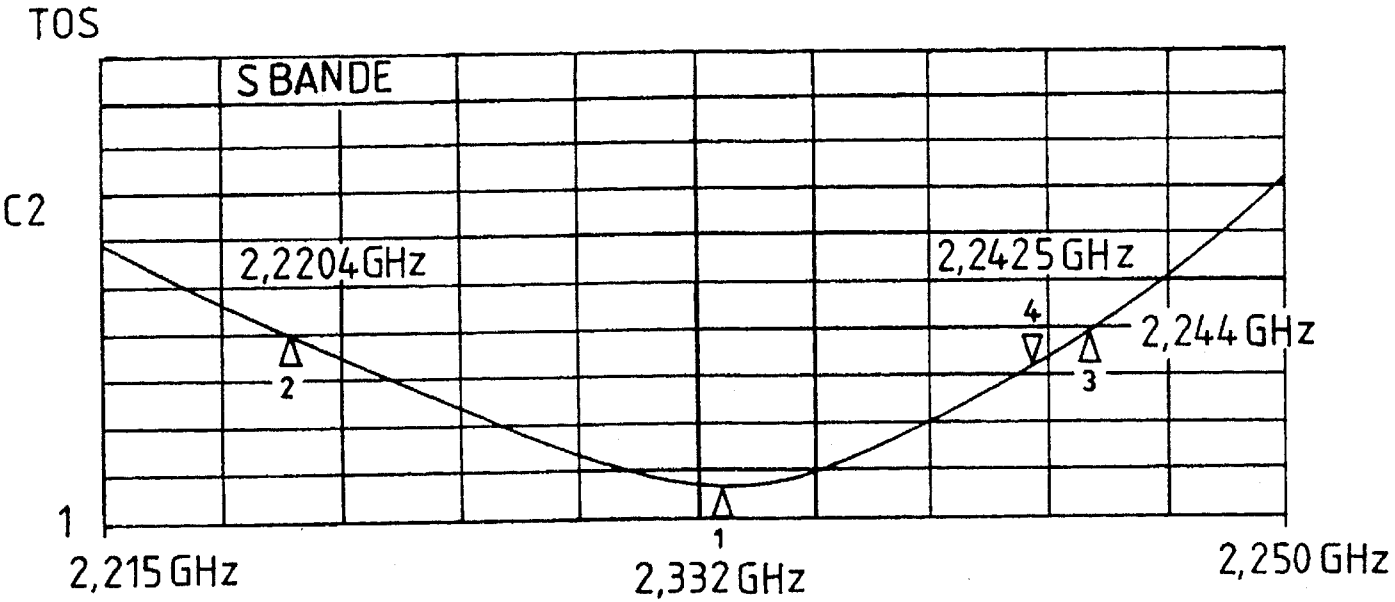
Figure 9B:
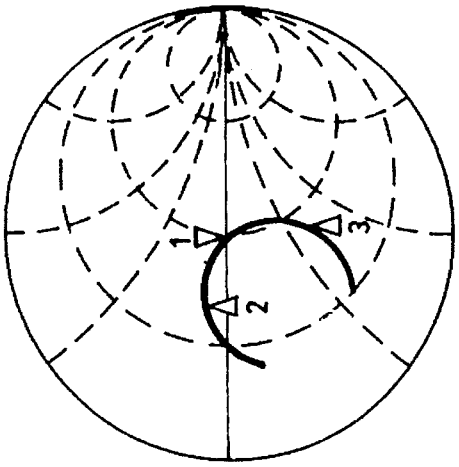
Figure 9A:
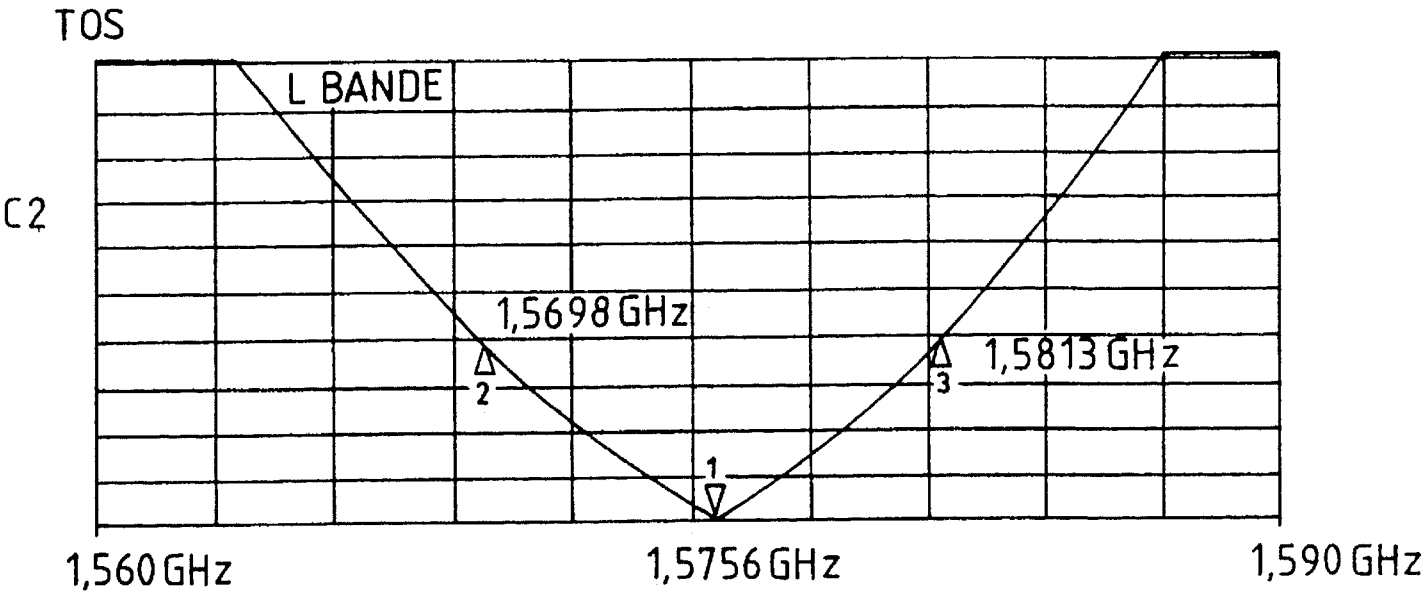
Figure 10A:
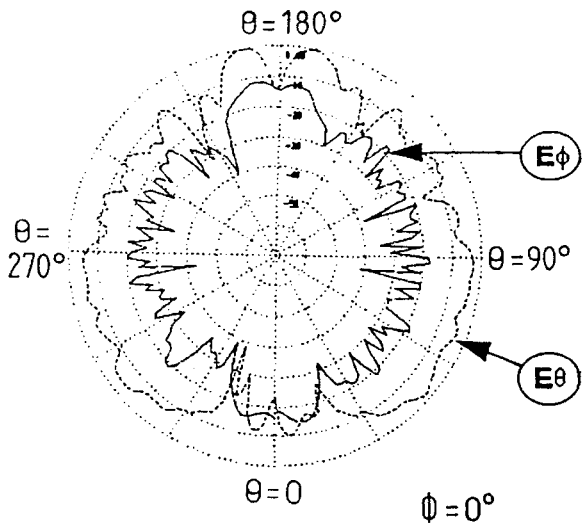
FIGS. 10A, 10B, 11A and 11B show the respective radiation performance of antennas made from the offset film of FIGS. 6 and 7, by means of ϕ=0 and θ=90° sections.
Figure 10B:
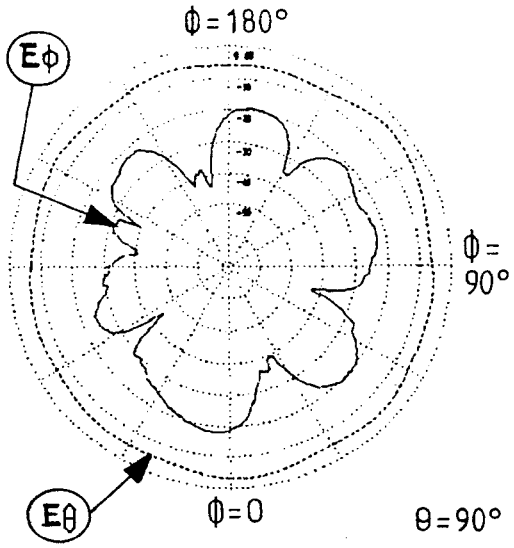
Figure 11A:
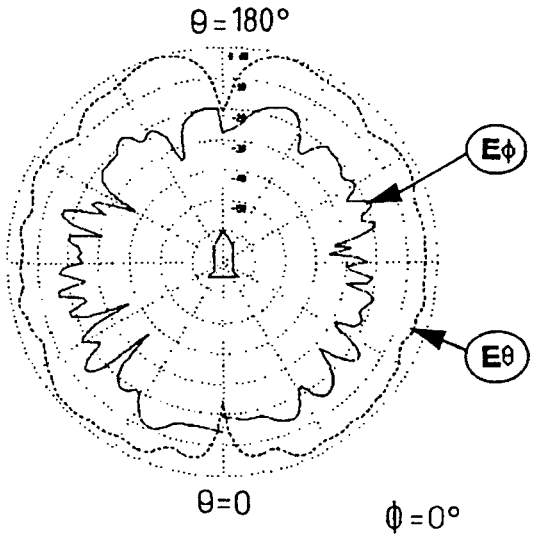
Figure 11B:
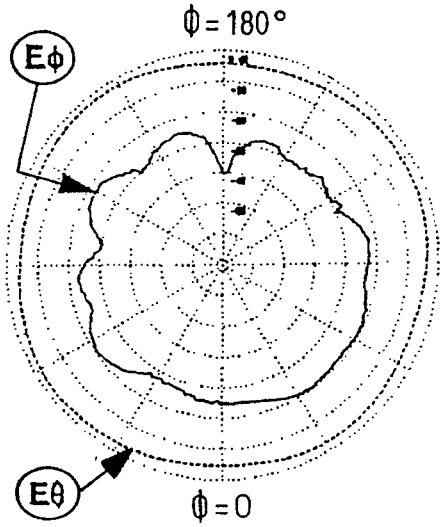

FIG. 5 illustrates the approximation contemplated, L is the circular arc to be approximated, with center 0; Δ1 and Δ2 are two equal-length straight line segments approximating the circular arc L. It is necessary to determine the angle τ between the two consecutive segments Δ1 and Δ2.

From considerations of symmetry: C=B. Accordingly: τ+B+C =π, and therefore: τ+2B=π. Since: A+2B=π, it follows that: τ=A, where A is the angle at the apex of the triangle whose sides are:

the segment in question, the segments joining the ends of this segment to the apex of the cone.

Since: $A=\Delta_{Lai}/Ra_i$, it follows that: $\tau_i=\Delta_{Lai}/Ra_i$+tm (6)

Equations (1) through (6) define simply and completely the geometry of the conical belt antenna and allow for constraints associated with the support structure and the required radio frequency performance.

The above equations are very simple to implement in a spreadsheet which gives instantaneously the composition and the dimensions of each stage of the feed array.

AEROSPATIALE has developed an application based on these equations which has been used to design printed circuit antennas on a thin flat substrate (dielectric constant=2.92), to etch them using the standard printed circuit technology, and then to conform them on a frustum of a cone with the following dimensions:

| | |
|---|---|
| half-angle at apex | α = 5.4° |
| base radius of frustum | R = 160 mm |
| height of frustum | $H_0$ = 280 mm |
| La | 1,005 mm |
| Ra | 1,705 mm |
| β | 33.92° |

The aim was to apply two conical belt antennas to this frustum.

One antenna, designed to resonate at 1,575 MHz, was to be positioned so that the lower edge of the radiating elements was 20 mm from the base of the frustum, the feed array being "over" the radiating patches. This antenna is an "L band" antenna.

The other antenna, operating at 2,233 MHz, was to be placed so that the upper edge of the radiating elements was at 20 mm from the top of the frustum, the feed array being "under" the radiating elements. This antenna is an "S band" antenna.

Adopting as a constraint conformance with the criterion of maximum spacing between radiating elements with a size of approximately λ /2 or less, and if the requirement is for numbers of patches in the form $N_s=2^{n2}3^{n3}$:

12 elements are required for the L band antenna, with two second order divider stages and one third order divider stage, and 16 elements are required for the S band antenna, with four second order divider stages.

The radiating elements are preferably trapezoidal in shape with their edges not parallel to the base of the frustum being substantially parallel to the generatrices of the cone (to within a tolerance of 25%).

When the dimensions of the radiating elements have been chosen (for example using appropriate prior art prediction software, followed by validation of their operation on a mock-up), their dimensions are verified for compatibility with the above constraint on the number of elements, i.e. to check that the patches are not superposed, in which case they would have to be "thinned out".

With the geometry of the problem thus determined, equations (1) through (6) are embodied in a spreadsheet and straight line segments with a length in the order of 55 mm are chosen for the various stages.

For FIG. 6:

| For FIG. 6: | |
|---|---|
| patch height | 42 mm |
| h | 223 mm |
| $h_0 = h_1 = h_2 = h_3$ | 12 mm |
| δ | 2.12° |
| and for FIG. 7: | |
| patch height | 56 mm |
| h | 71 mm |
| $h_0$ | 12 mm |
| δ | 2.83° |

The results in the case of the problem as stated are set out in tables 1 and 2. FIGS. 6 and 7 show the etching masks obtained. The lengths of the straight line segments (which can hardly be distinguished in these figures because of the scale employed) can be exploited to modify the line width to provide adapters. By optimization, these adapters can match the impedance of the antenna at the connection point to a value close to 50 ohms (VSWR approximately 1 and less than 2 in an imposed frequency band).

FIGS. 8A and 8B and FIGS. 9A and 9B show the matching performance of each antenna. FIGS. 10A and 10B and FIGS. 11A and 11B show the main sections of their radiation patterns for a given structure.

In practice, all the dimensions or lengths stated hereinabove are subject to a tolerance of up to ±15%, depending on various constraints such as the impact of rounded bends, for example.

It goes without saying that the foregoing description has been given by way of non-limiting example only and that numerous variants can be put forward by the person skilled in the art without departing from the scope of the invention.

Figure 12:
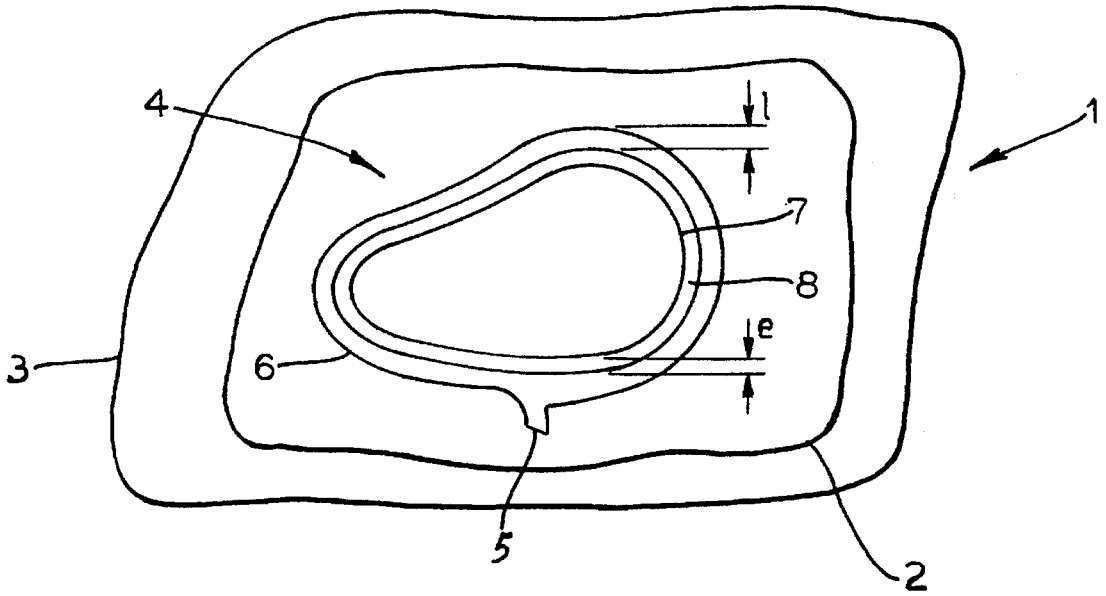
FIG. 12 shows a patch 4 formed on a substrate 2 including a radiating patch 6 formed in a conductive loop of constant width 1 surrounding a dummy patch 7 which is not energized and from which it is separated by a continuous closed loop slot 8 of constant width e coupling the loop 6 to the dummy patch 7.

In particular, the radiating patches can have varied shapes and geometries, for example as proposed in French patent application 92-07274, each patch being formed by a conductive loop of constant width l surrounding a dummy patch which is not energized and from which it is separated by a continuous closed loop slot of constant width e coupling the loop to the dummy patch as shown in FIG. 12.

TABLE 1

| i= | 1 | 2 | 3 | 4 |
|---|---|---|---|---|
| Rai (mm) | 1518.22056 | 1506.22056 | 1494.22056 | 1482.22056 |
| Lai (mm) | 449.527088 | 222.987015 | 110.605243 | 54.8584894 |
| no of portions | 8 | 4 | 2 | 1 |
| Δ Lai | 56.190886 | 55.7467538 | 55.3026216 | 54.8584894 |
| γi | 2.12057504 | 2.12057504 | 2.12057504 | 2.12057504 |

TABLE 2

| i= | 1 | 2 | 3 |
|---|---|---|---|
| Rai (mm) | 1598.22056 | 1610.22056 | 1622.22056 |
| Lai (mm) | 473.214139 | 238.383598 | 160.106751 |
| no of portions | 12 | 6 | 6 |
| Δ Lai | 39.4345116 | 39.7305997 | 26.6844586 |
| γi | 1.41371669 | 1.41371669 | 0.9424778 |

There is claimed:

1. A microstrip antenna which can be carried by a frustum of a cone, said cone having a height H, a half-angle α at the apex, and a base with a corresponding circular reference line of radius R, said frustum of said cone having a height $H_o$ and sharing said base and said circular reference line with said cone, said microstrip antenna comprising:

a layer of dielectric material disposed on said frustum and having a first surface and a second surface;

a conductive layer, complementary with said second surface of said layer of dielectric material for forming a ground plane;

an annular succession of N radiating patches made of a conductive metal disposed on said first surface and divided into S identical sub-arrays of radiating patches, each sub-array of radiating patches, of said S identical sub-arrays of radiating patches, having radiating patches which are shaped so that said radiating patches resonate in a predetermined frequency band having a center frequency $F_o$; and at least one feed array for each said S identical subarrays of radiating patches, each feed array, of said at least one feed array, comprising:

a common point, each said at least one feed array connecting said radiating patches of said at least one sub-array of radiating patches to said common point; and conductive lines, said conductive lines having lengths for forming a tree-structure array of dividers such that said lengths of said conductive lines between said common point and said radiating patches are substantially identical in length to within $c/(F_o\sqrt{\in e})$ where c is the speed of light and ∈e is the effective dielectric constant of a propagation medium constituted by a dielectric substrate and said conductive lines, said tree-structure array of dividers being formed on the same said surface of said layer of dielectric material that said conductive metal of said radiating patches is formed, said tree-structure array of dividers having n stages, each stage i of said n stages having at least one divider of said dividers, all said dividers which are within a same stage of said n stages being of the same order, each divider of said at least one divider within said stage i of said n stages comprising an integer number of substantially identical straight line segments with equal angles γ2 between said straight line segments when developed onto a flat surface, all said dividers within said stage i approximating arcs of a common circle which is concentric with a circular arc formed by said circular reference line when developed onto a flat surface, said straight line segments of said stage i of said n stages each having a length $\Delta La_i$ and each of two said straight line segments which are adjacent to each other having an angle γi between them such that $$Na_i = La_i/\Delta La_i,$$

said $Na_i$ being an integer number of said straight line segments for said stage i, said integer number being equal to or greater than 1, where $$La_i = 2\pi\sin(\alpha)\ Ra_i 2^{\delta 3}/[S(2^{i-m}3^m)],$$

said δ3 being Chrönecker's symbol, said Chrönecker's symbol having a value equal to 1 if said stage i has at least one said divider which is of third order and said Chrönecker's symbol having a value equal to 0 if said stage i has at least one said divider which is of second order, said m being the number of stages having at least one divider which is of third order between stage 1 of n number of total stages and said stage i of said n stages, said stages having at least one divider which is of third order being counted within each identical sub-array of said S identical sub-arrays from said common point, and where $$Ra_i = H/\cos(\alpha) - h + (n - i + 1)\, p \sum_{k=1}^{k=i} h_k,$$

said p having a value equal to 1 if said feed array is under said radiating patches and said p having a value equal to −1 if said feed array is over said radiating patches, each radiating patch of said radiating patches having an edge, said h being the distance between said circular reference line of said frustum and said edge of a radiating patch of said radiating patches connected to said feed array, said $h_k$ being the height of a stage k of said n stages, said angle γi being equal to $\Delta La_i/Ra_i$.

2. A microstrip antenna according to claim 1, wherein each radiating patch of said radiating patches is trapezoidal in shape.

3. A microstrip antenna according to claim 1, wherein each radiating patch of said radiating patches is rectangular in shape.

4. A microstrip antenna according to claim 1, wherein each radiating patch of said radiating patches is circular in shape.

5. A microstrip antenna according to claim 1, wherein said conductive metal of each radiating patch of said radiating patches forms a conductive loop and a dummy patch, said conductive loop having a constant width l, said dummy patch not being energized, said conductive loop surrounding said dummy patch and being separated from said dummy patch by a continuous closed-loop slot of constant width e, said conductive loop being electromagnetically coupled with said dummy patch.

6. A microstrip antenna according to claim 1, wherein each straight line segment of said straight line segments has a length which is at least equal to approximately one-quarter of the wavelength of an electromagnetic wave propagating along said straight line segment, said wavelength depending on said frequency of said electromagnetic wave and the effective dielectric constant characteristic of the electromagnetic wave's propagation medium, said propagation medium constituted by a dielectric substrate and said straight line segment of a conductive line of said conductive lines.

7. A microstrip antenna according to claim 1, wherein a height is associated with each stage of said n stages, said height being the same for each stage of said n stages.

8. Method of preparing a microstrip antenna adapted to be carried by a frustum of a cone, said cone having a height H, a half angle $\alpha$ at the apex, and a base with a corresponding circular reference line of radius R, said frustum of said cone having a height $H_o$ and sharing said base and said reference line with said cone, said antenna including an annular succession of N radiating patches disposed on said frustum and divided into at least one sub-array of radiating patches connected by a respective feed array to the same common point, said N radiating patches being made from a conductive material on a surface of a dielectric material layer, said dielectric material layer carrying on its other surface a conductive layer forming a ground plane, and said radiating patches being shaped to resonate in a predetermined frequency band having a center frequency $F_o$, in which the method comprises the steps of:

choosing arbitrarily numbers S, n2 and n3 such that $N=S2^{n2}3^{n3}$;

dividing said N radiating patches into S sub-arrays;

selecting each feed array such that the line lengths between said common point and said radiating patches of said sub-array are substantially identical to within $c/(F_o\sqrt{\in e})$ where c is the speed of light and $\in e$ is the effective dielectric constant of the propagation medium constituted by the substrate and the conductive lines;

forming a tree-structure array on the same surface of said dielectric material layer as said sub-array of said radiating patches, said tree-structure array is made up of n2 stages of second order dividers and n3 stages of third order dividers, in any order; and conforming said dividers within the same stage i so that each, when developed on a plane, comprises an integer number of substantially identical straight line segments with equal angles i between them, said dividers of a same stage approximating arcs of a common circle concentric with the circular arc constituted by said circular reference line when developed on said plane, a length $\Delta La_i$ of said straight line segments of stage i and said angle $\gamma i$ between adjacent segments are such that:

a) $Na_i=La_i/\Delta La_i$ is an integer number (the number of sections for stage i) greater than or equal to 1, where:

$$La_i=2\pi\sin(\alpha)\ Ra_i 2^{\delta 3}/[S(2^{i-m}3^m)]$$

where $\delta 3$ is Chrönecker's symbol, which has the value 1 if stage i is a third order stage or the value 0 if stage i is a second order stage, m is the number of third order stages between said first stage and said ith stage of n number of total stages, said stages being counted from said common point, and $$Ra_i = H/\cos(\alpha) - h + (n-i+1)\,p \sum_{k=1}^{k=i} h_k,$$

where

P is 1 if said feed array is under said radiating elements and −1 if said feed array is over said radiating elements, h is the distance between said reference line of said frustum and the edge of said radiating element connected to said feed array, and $h_k$ is the height of stage k;

b) said angle $\tau i$, the angle between two consecutive segments, is equal to $\Delta La_i/Ra_i$.

9. A method of preparing a microstrip antenna according to claim 8, wherein the step of shaping each radiating patch includes shaping each radiating patch of said radiating patches such that each said radiating patch is trapezoidal in shape.

10. A method of preparing a microstrip antenna according to claim 8, wherein the step of shaping each radiating patch includes shaping each radiating patch of said radiating patches such that each said radiating patch is rectangular in shape.

11. A method of preparing a microstrip antenna according to claim 8, wherein the step of shaping each radiating patch includes shaping each radiating patch of said radiating patches such that each said radiating patch is circular in shape.

12. A method of preparing a microstrip antenna according to claim 8, wherein the step of shaping each radiating patch includes shaping said conductive material of each radiating patch of said radiating patches into a conductive loop and a dummy patch, said conductive loop having a constant width l, said dummy patch not being energized, said conductive loop surrounding said dummy patch and being separated from said dummy patch by a continuous closed-loop slot of constant width e, said conductive loop being electromagnetically coupled with said dummy patch.

13. A method of preparing a microstrip antenna according to claim 8, wherein the step of conforming said dividers within the same stage i of said n stages includes making each straight line segment of said straight line segments such that each said straight line segment has a length which is at least equal to approximately one-quarter of the wavelength of an electromagnetic wave propagating along said straight line segment, said wavelength depending on the frequency of said electromagnetic wave and the effective dielectric constant characteristic of the electromagnetic wave's propagation medium, said propagation medium constituted by a dielectric substrate and said straight line segment of a conductive line of said conductive lines.

14. A method of preparing a microstrip antenna according to claim 8, said method further comprising the step of making each stage of said n stages such that each said stage has the same height.

* * * * *

UNITED STATES PATENT AND TRADEMARK OFFICE

CERTIFICATE OF CORRECTION

PATENT NO. : 5,600,331 Page 1 of 2

DATED : February 4, 1997

INVENTOR(S) : Buralli

It is certified that error appears in the above-identified patent and that said Letters Patent is hereby corrected as shown below:

Column 2, line 1, after "*P*", both occurrences, kindly delete "1".

Column 7, line 25, kindly delete "1" and insert ---- e ----.

Column 8, line 32, after "diagram", kindly insert ---- and ----.

Column 8, line 34, after "sections;", kindly insert ---- and ----; same line, after the semi-colon ";", kindly begin a new paragraph.

Column 10, line 10, kindly delete "1<i<"and insert ---- $1 \leq i \leq$ ----.

Column 10, line 25, kindly delete "$Ra_{i=Ra-h+p(n-i+1)}h_o$" and insert ---- Rai=ra-h+p(n-i+1)$h_o$ ----.

Column 10, line 30, kindly delete "$_{Lai=\delta Rar}Ns2^{\delta 3}/(2^{i-m}3^m)=\beta Ra_i/(s2^i-^m3^m)$" and insert ---- delete "$Lai=\delta RarNs2^{\delta 3}/(2^{i-m}3^m)=\beta Ra_i/(s2^i-^m3^m)$;

Column 10, line 34; kindly delete "1<i<"and insert ---- $1 \leq i \leq$ ----.

UNITED STATES PATENT AND TRADEMARK OFFICE

CERTIFICATE OF CORRECTION

PATENT NO. : 5,600,331

DATED : February 4, 1997

INVENTOR(S) : Buralli

It is certified that error appears in the above-identified patent and that said Letters Patent is hereby corrected as shown below:

Column 11, line 34 kindly delete "+tm".

Column 14, line 67, kindly delete "the" and insert ---- said ----.

Signed and Sealed this

Twenty-ninth Day of December, 1998

*Attest:*

*Attesting Officer*

BRUCE LEHMAN

*Commissioner of Patents and Trademarks*